US009302684B2

(12) United States Patent
Kawashima et al.

(10) Patent No.: US 9,302,684 B2
(45) Date of Patent: Apr. 5, 2016

(54) RAILCAR DOOR APPARATUS AND RAILCAR

(71) Applicant: KAWASAKI JUKOGYO KABUSHIKI KAISHA, Kobe-shi, Hyogo (JP)

(72) Inventors: Takahiro Kawashima, Nishinomiya (JP); Tsunetoshi Goto, Kobe (JP); Hiroyuki Hirata, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 14/380,471

(22) PCT Filed: Dec. 3, 2012

(86) PCT No.: PCT/JP2012/007734
§ 371 (c)(1),
(2) Date: Aug. 22, 2014

(87) PCT Pub. No.: WO2014/087443
PCT Pub. Date: Jun. 12, 2014

(65) Prior Publication Data

US 2015/0007745 A1 Jan. 8, 2015

(51) Int. Cl.
*B61D 19/00* (2006.01)
*B61D 19/02* (2006.01)

(52) U.S. Cl.
CPC ..... *B61D 19/005* (2013.01); *B61D 19/00* (2013.01); *B61D 19/026* (2013.01)

(58) Field of Classification Search
CPC .... B61D 19/00; B61D 19/005; B61D 19/006; B61D 19/007; B61D 19/008
See application file for complete search history.

(56) References Cited

U.S. PATENT DOCUMENTS 4,133,365 A * 1/1979 Schleicher ..... B60J 10/0091 160/118
5,280,754 A * 1/1994 Flanagan ..... E05F 15/40 105/341
5,335,710 A * 8/1994 Belanger ..... E06B 3/805 160/118
5,438,800 A * 8/1995 Porter ..... B60J 5/062 49/209

(Continued)

FOREIGN PATENT DOCUMENTS

CH 399 925 9/1965
JP A-2011-126368 6/2011

OTHER PUBLICATIONS

International Search Report issued in International Application No. PCT/JP2012/007734 dated Feb. 26, 2013.

*Primary Examiner* — Jason C Smith
(74) *Attorney, Agent, or Firm* — Oliff PLC

(57) ABSTRACT

A railcar door apparatus includes: a side sliding door that opens and closes an opening of a side bodyshell of a railcar; a first elastic member attached vertically to an end of the door; and a second elastic member opposed to the first so they do not touch when the door is closed. The first elastic member includes a first base portion and a first projecting wall portion projecting from the base toward the second elastic member; the second elastic member includes a second base portion and a second projecting wall portion projecting from the base toward the first elastic member; when the door is closed, a gap space is formed between the first and second elastic members, and the projecting wall portions overlap; and vertical grooves or projections are formed on the outside of at least one of the projecting wall portions, the outer surface facing the gap space.

6 Claims, 6 Drawing Sheets

(56) References Cited

U.S. PATENT DOCUMENTS 5,893,236 A * 4/1999 Krbec ..... B61D 19/008 49/118
RE36,825 E * 8/2000 Dailey ..... B60J 10/0091 49/27
6,598,539 B2 * 7/2003 Oakley ..... B61D 19/02 105/329.1
7,603,813 B2 * 10/2009 Hackl ..... E05F 15/42 49/120
7,802,521 B2 * 9/2010 Gunes ..... B61B 1/02 104/27
8,061,084 B2 * 11/2011 Katzensteiner ..... B60J 10/0091 49/27
2005/0235866 A1 * 10/2005 Stojc ..... E05B 77/00 105/343
2010/0188177 A1 * 7/2010 Inage ..... B61D 19/005 335/205
2014/0366449 A1 * 12/2014 Masuda ..... B61D 19/007 49/281
2015/0007745 A1 * 1/2015 Kawashima ..... B61D 19/00 105/343
2015/0054294 A1 * 2/2015 Uno ..... E05F 15/635 292/194
2015/0158503 A1 * 6/2015 Yamaguchi ..... B61D 19/009 49/360
2015/0217785 A1 * 8/2015 Mair ..... B61D 19/008 49/176

* cited by examiner

RAILCAR DOOR APPARATUS AND RAILCAR

TECHNICAL FIELD

The present invention relates to a railcar door apparatus and a railcar.

BACKGROUND ART

To prevent water from entering into a railcar from the outside of the railcar and prevent clothes and the like of a passenger from being caught in a door, a door leading edge rubber is attached to a tip end of a side sliding door that opens and closes a door opening portion of a side bodyshell of the railcar. As the door leading edge rubber, there are a contactless type and a contact type.

FIG. 6 of PTL 1 discloses a side sliding door at which a pair of contactless type door leading edge rubbers are provided. In this side sliding door, one of the door leading edge rubbers has a concave shape whereas the other door leading edge rubber has a convex shape. When the side sliding door is completely closed, a pair of door leading edge rubbers are fitted to each other so as not to contact each other. This is advantageous in that since the door leading edge rubber is the contactless type, the clothes of the passenger caught in the side sliding door is easily taken out. However, there is a problem that if it rains or when washing the railcar, water easily enters from the outside of the railcar into the inside of the railcar through a gap formed between the pair of door leading edge rubbers.

Each of PTLs 2 and 3 discloses a side sliding door at which a pair of contact type door leading edge rubbers are provided. Each of these side sliding doors is advantageous in that since the pair of door leading edge rubbers contact each other when the side sliding door is completely closed, the waterproof performance is high. However, when the side sliding door is completely closed, the contact type door leading edge rubbers push each other, so that reaction force is applied to the side sliding door. A door operation device of the side sliding door is provided with a sensor that detects that the clothes, belongings, and the like of the passenger have been caught in the side sliding door. However, the above reaction force may become a cause of misdetection of the sensor depending on the positioning of the side sliding door and the setting of a detection threshold of the sensor. Further, since the rubbers contact each other, problems are that the rubbers easily deteriorate due to abrasion and the like, so that the waterproof performance and the life decrease.

PTL 4 discloses a side sliding door at which a pair of lip contact type door leading edge rubbers are provided. When this side sliding door is completely closed, a lip provided at one of the door leading edge rubbers contacts the other door leading edge rubber. Therefore, this side sliding door is advantageous in that the waterproof performance of the lip contact type door leading edge rubbers is higher than that of the contactless type door leading edge rubbers. However, if a contact force of the lip is inadequate, the waterproof performance may decrease. In addition, since the lip that is a thin rubber contacts the door leading edge rubber, problems are that the thin rubber easily deteriorates due to abrasion and the like with long-term use, so that the waterproof performance and the life decrease.

CITATION LIST

Patent Literature

PTL 1: U.S. Pat. No. 5,280,754
PTL 2: U.S. Pat. No. Re. 36825

PTL 3: Japanese Laid-Open Patent Application Publication No. 2011-126368
PTL 4: U.S. Pat. No. 8,061,084

SUMMARY OF INVENTION

Technical Problem

As described above, each of the contactless type door leading edge rubber and the contact type door leading edge rubber has advantages and disadvantages, and there is a need to eliminate the disadvantages while utilizing the advantages. An object of the present invention is to provide a door apparatus which is a contactless type and by which water is unlikely to enter into the inside of the railcar from the outside of the railcar, and a railcar including the door apparatus.

Solution to Problem

A railcar door apparatus according to the present invention includes: a side sliding door configured to open and close a door opening portion of a side bodyshell of a railcar; a first elastic member attached to a door end of the side sliding door in a vertical direction; and a second elastic member opposed to the first elastic member so as not to contact the first elastic member when the side sliding door is completely closed, wherein: the first elastic member includes a first base portion and a first projecting wall portion projecting from the first base portion toward the second elastic member; the second elastic member includes a second base portion and a second projecting wall portion projecting from the second base portion toward the first elastic member; when the side sliding door is completely closed, a gap space is formed between the first elastic member and the second elastic member, and the first projecting wall portion and the second projecting wall portion are located so as to overlap each other when viewed from a normal direction of the side sliding door; and a plurality of grooves or projections extending in the vertical direction are formed on an outer surface of at least one of the first projecting wall portion and the second projecting wall portion, the outer surface facing the gap space.

According to the above configuration, since the gap space is formed between the first elastic member and the second elastic member when the side sliding door is completely closed, the advantage of the contactless type can be achieved, that is, the clothes and the like of the passenger caught in the side sliding door are easily taken out. In addition, since the plurality of grooves or projections extending in the vertical direction are formed on the outer surface, facing the gap space, of at least one of the first projecting wall portion and the second projecting wall portion that overlap each other when viewed from the normal direction of the side sliding door in a state where the sliding door is completely closed, the length of the outer surface from the outside of the railcar to the inside of the railcar can be increased. With this, for example, the water having entered into the gap space from the outside of the railcar falls down to a lower end of the gap space before the water reaches the inside of the railcar. Thus, the water can be successfully prevented from entering into the inside of the railcar from the outside of the railcar.

Advantageous Effects of Invention

As is clear from the above explanations, the railcar door apparatus according to the present invention can successfully prevent the water from entering into the inside of the railcar from the outside of the railcar although the door apparatus is a contactless type.

DESCRIPTION OF EMBODIMENTS

Hereinafter, embodiments will be explained in reference to the drawings.

Embodiment 1

Figure 1:
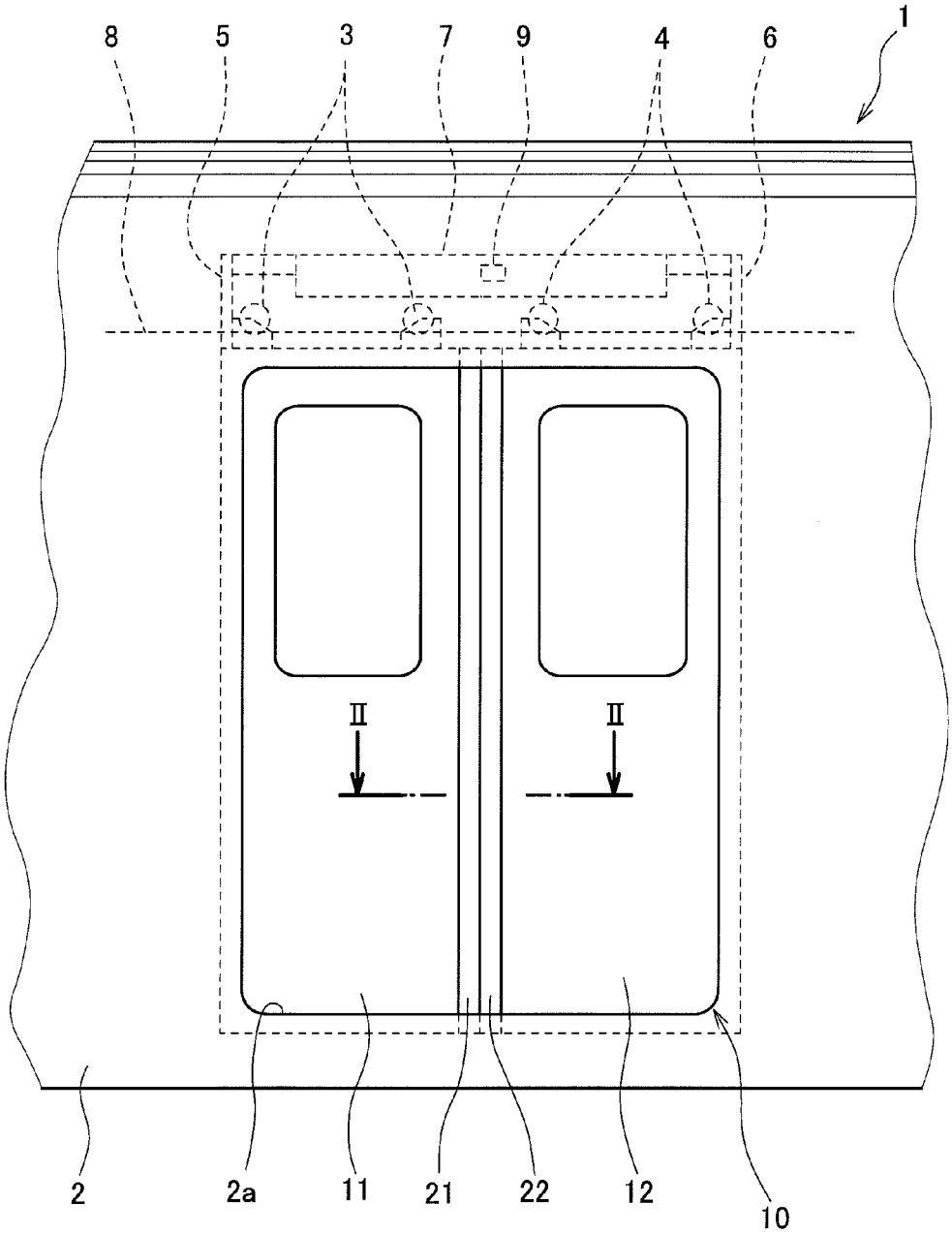
FIG. 1 is a side view showing a railcar door apparatus according to Embodiment 1 and the vicinity of the door apparatus.

FIG. 1 is a side view showing a door apparatus 10 of a railcar 1 according to Embodiment 1 and the vicinity of the door apparatus 10. As shown in FIG. 1, the railcar 1 includes: a side bodyshell 2 on which a door opening portion 2*a* is formed; and the door apparatus 10 that opens and closes the door opening portion 2*a* and is a double sliding door. The door apparatus 10 includes: a first side sliding door 11 and a second side sliding door 12 which slide to close and open, that is, to get close to each other and be separated from each other; and a first elastic member 21 and a second elastic member 22 that are a pair of door leading edge rubbers respectively attached to door ends of the side sliding doors 11 and 12 in a vertical direction. Pulleys 3 and 4 are respectively attached to upper portions of the first and second side sliding doors 11 and 12 and are guided by a guide rail 8 provided above the door opening portion 2*a*. A door driving device 7 that causes the first and second side sliding doors 11 and 12 to slide to open and close via brackets 5 and 6 is provided above the first and second side sliding doors 11 and 12. As the door driving device 7, there are a pneumatic type that drives using compressed air and an electric type that drives using a motor. The door driving device 7 is provided with an abnormality detector 9 configured to detect that a foreign matter is caught in the door apparatus 10, based on resistance generated when closing the first and second side sliding doors 11 and 12. There are various positions of the door driving device and various guide mechanisms of the side sliding door. Therefore, the position of the door driving device is not limited to the above, and the guide mechanism of the side sliding door is not limited to the above.

Figure 2:
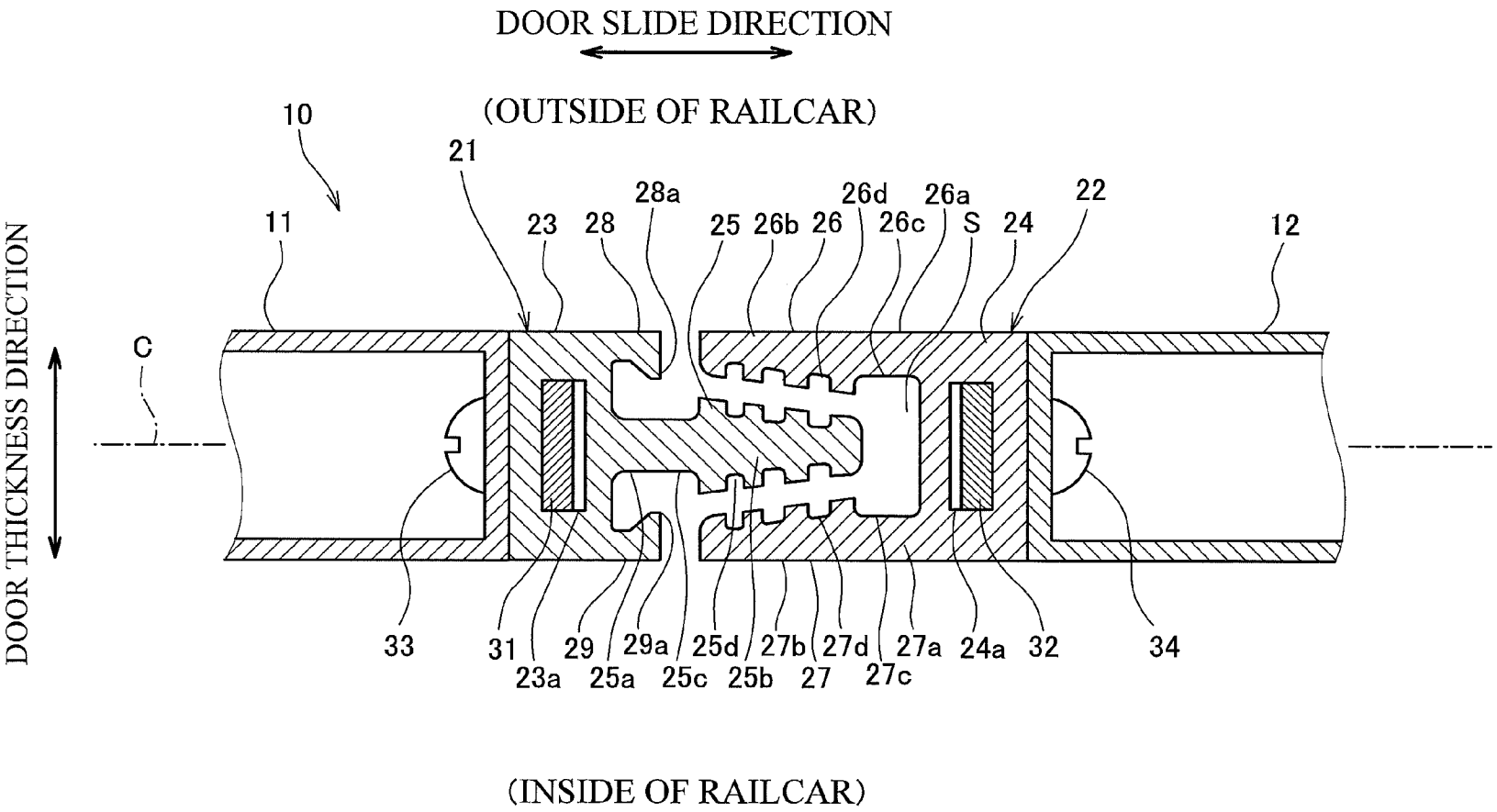
FIG. 2 is a horizontal cross-sectional view taken along line II-II of FIG. 1.

FIG. 2 is a horizontal cross-sectional view taken along line II-II of FIG. 1. As shown in FIG. 2, the first elastic member 21 and the second elastic member 22 are made of rubber and are symmetrical about a door center line C in a door thickness direction. When the first and second side sliding doors 11 and 12 are completely closed, the first elastic member 21 and the second elastic member 22 are opposed to each other so as not to contact each other. That is, the door apparatus 10 is a contactless type.

The first elastic member 21 includes: a first base portion 23 fixed to a tip end of the first side sliding door 11; and a first projecting wall portion 25 projecting on the center line C from a door thickness direction middle portion of the first base portion 23 toward the second elastic member 22 in a door slide direction. The second elastic member 22 includes: a second base portion 24 fixed to a tip end of the second side sliding door 12; a second projecting wall portion 26 projecting from one of door thickness direction end portions of the second base portion 24 toward the first elastic member 21 in the door slide direction; and a third projecting wall portion 27 projecting from the other door thickness direction end portion of the second base portion 24 toward the first elastic member 21 in the door slide direction.

Hollow portions 23*a* and 24*a* extending in the vertical direction are respectively formed at the first base portion 23 and the second base portion 24, and metal plates 31 and 32 are respectively inserted in the hollow portions 23*a* and 24*a*. Screws 33 and 34 are respectively inserted from the insides of the side sliding doors 11 and 12 through the base portions 23 and 24 to be respectively fixed to the metal plates 31 and 32. With this, the first elastic member 21 and the second elastic member 22 are respectively fixed to the first side sliding door 11 and the second side sliding door 12. When the first and second side sliding doors 11 and 12 are completely closed by the door driving device 7 (FIG. 1), a gap space S is formed between the first elastic member 21 and the second elastic member 22, and the first to third projecting wall portions 25 to 27 are located so as to overlap each other when viewed from a normal direction of the side sliding doors 11 and 12.

The first projecting wall portion 25 includes: a base-side portion 25*a* continuous from the first base portion 23; and a tip end-side portion 25*b* continuous from the base-side portion 25*a* toward a tip end side. The tip end-side portion 25*b* is opposed to the second projecting wall portion 26 and the third projecting wall portion 27 in the door thickness direction. The base-side portion 25*a* connects the tip end-side portion 25*b* and the first base portion 23. Both side surfaces of the tip end-side portion 25*b* are inclined such that the thickness of the tip end-side portion 25*b* decreases toward the tip end. Large grooves 25*c* are respectively formed on both side surfaces, facing the gap space S, of the base-side portion 25*a*. A plurality of small grooves 25*d* are formed on each of both side surfaces, facing the gap space S, of the tip end-side portion 25*b*. Each of the large grooves 25*c* and the small grooves 25*d* is recessed in the door thickness direction and is formed from an upper end to a lower end so as to extend in the vertical direction. The width of the large groove 25*c* in the door slide direction is larger than the width of the small groove 25*d* in the door slide direction.

The second projecting wall portion 26 includes: a base-side portion 26*a* continuous from the second base portion 24; and a tip end-side portion 26*b* continuous from the base-side portion 26*a* toward the tip end side. The third projecting wall portion 27 includes: a base-side portion 27*a* continuous from the second base portion 24; and a tip end-side portion 27*b* continuous from the base-side portion 27*a* toward the tip end side. The tip end-side portions 26*b* and 27*b* are opposed to the first projecting wall portion 25 in the door thickness direction. The base-side portion 26*a* connects the tip end-side portion

26*b* and the second base portion 24, and the base-side portion 27*a* connects the tip end-side portion 27*b* and the second base portion 24. An inner side surface of the tip end-side portion 26*b* is inclined such that the thickness of the tip end-side portion 26*b* decreases toward the tip end. An inner side surface of the tip end-side portion 27*b* is inclined such that the thickness of the tip end-side portion 27*b* decreases toward the tip end. A large groove 26*c* is formed on an inner side surface, facing the gap space S, of the base-side portion 26*a*, and a large groove 27*c* is formed on an inner side surface, facing the gap space S, of the base-side portion 27*a*. A plurality of small grooves 26*d* are formed on an inner side surface, facing the gap space S, of the tip end-side portion 26*b*, and a plurality of small grooves 27*d* are formed on an inner side surface, facing the gap space S, of the tip end-side portion 27*b*. Each of the large grooves 26*c* and 27*c* and the small grooves 26*d* and 27*d* is recessed in the door thickness direction and is formed from the upper end to the lower end so as to extend in the vertical direction. The width of each of the large grooves 26*c* and 27*c* in the door slide direction is larger than the width of each of the small grooves 26*d* and 27*d* in the door slide direction. The depth of each of the large grooves 26*c* and 27*c* in the door thickness direction is substantially the same as the depth of each of the small grooves 26*d* and 27*d* in the door thickness direction. The small grooves 25*d* of the first projecting wall portion 25 are arranged so as to be opposed to the small grooves 26*d* and 27*d* of the second and third projecting wall portions 26 and 27.

Both door thickness direction end portions of the first base portion 23 are respectively opposed to tip ends of the second and third projecting wall portions 26 and 27. Convex portions 28 and 29 are respectively provided at both door thickness direction end portions of the first base portion 23, are spaced apart from the first projecting wall portion 25 in the horizontal direction (door thickness direction), and respectively project toward the tip ends of the second and third projecting wall portions 26 and 27. Each of projection lengths of the convex portions 28 and 29 is smaller than a projection length of the first projecting wall portion 25 and also smaller than the width of the large groove 25*c* in the door slide direction. Each of the convex portions 28 and 29 is formed from the upper end to the lower end of the first base portion 23 in the vertical direction. The convex portion 28 includes a rib 28*a* located at a tip end portion thereof and projecting toward the first projecting wall portion 25 in the door thickness direction, and the convex portion 29 includes a rib 29*a* located at a tip end portion thereof and projecting toward the first projecting wall portion 25 in the door thickness direction. The rib 28*a* is formed from the upper end to the lower end of the convex portion 28 in the vertical direction, and the rib 29*a* is formed from the upper end to the lower end of the convex portion 29 in the vertical direction. The rib 28*a* projects at the tip end portion of the convex portion 28 in a tapered shape toward the first projecting wall portion 25, and the rib 29*a* projects at the tip end portion of the convex portion 29 in a tapered shape toward the first projecting wall portion 25. Tip end surfaces of the convex portions 28 and 29 are flat surfaces parallel to tip end surfaces of the second and third projecting wall portions 26 and 27.

A distance between the tip end of the first projecting wall portion 25 and the second base portion 24 in the door slide direction is substantially the same as each of the widths of the large grooves 26*c* and 27*c* of the second and third projecting wall portions 26 and 27. In a state where the first and second side sliding doors 11 and 12 are completely closed, the position of the tip end of the first projecting wall portion 25 substantially coincides with each of the position of an end portion, located at the tip end-side portion 26*b* side, of the large groove 26*c* and the position of an end portion, located at the tip end-side portion 27*b* side, of the large groove 27*c* in the door slide direction. In a state where the first and second side sliding doors 11 and 12 are completely closed, each of the positions of the tip ends of the second and third projecting wall portions 26 and 27 substantially coincides with the position of an end portion, located at the tip end-side portion 25*b* side, of the large groove 25*c* in the door slide direction. Each of a distance between the tip end of the second projecting wall portion 26 and the convex portion 28 of the first base portion 23 in the door slide direction and a distance between the tip end of the third projecting wall portion 27 and the convex portion 29 of the first base portion 23 in the door slide direction is smaller than the width of the large groove 25*c* in the door slide direction.

Figure 3:
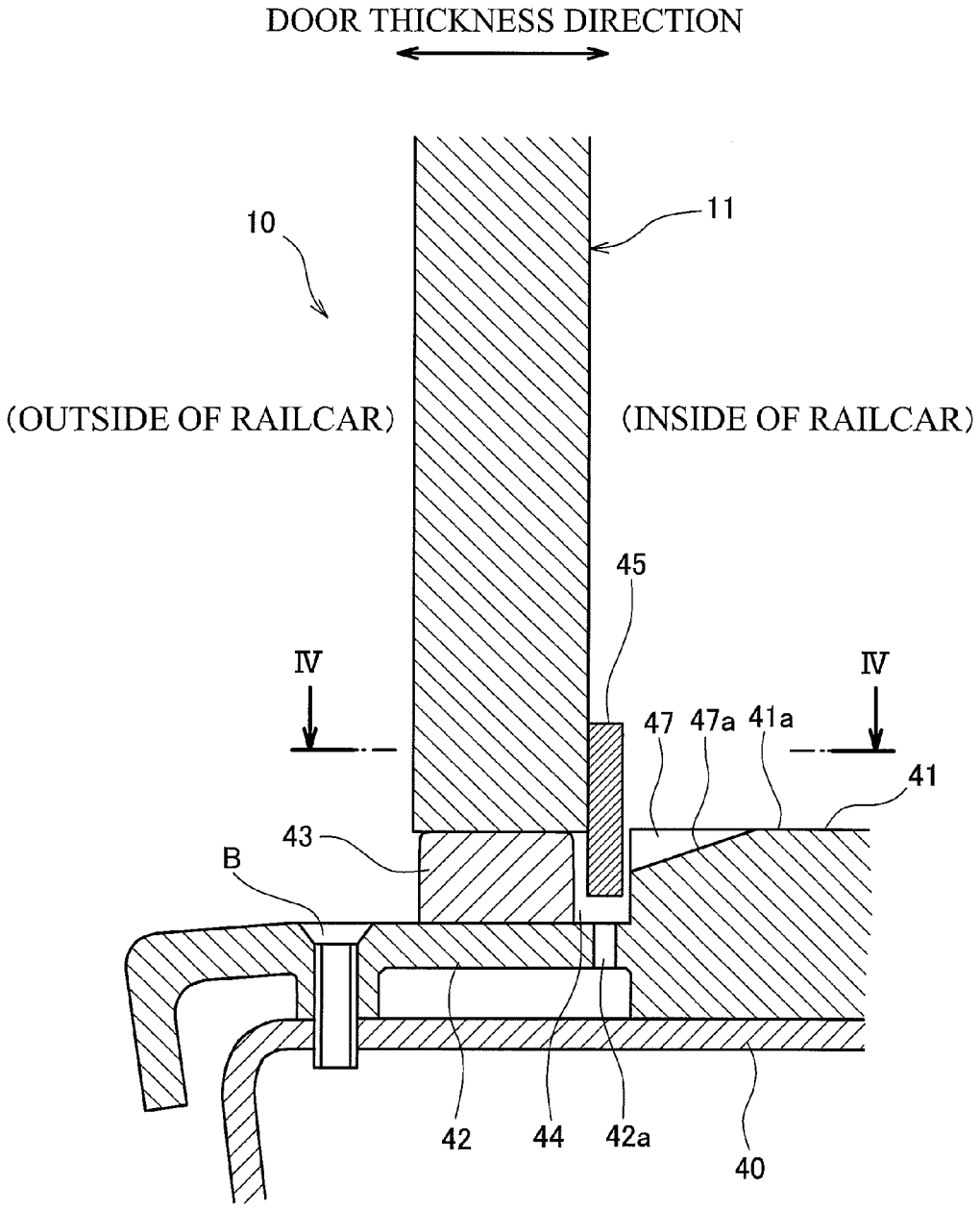
FIG. 3 is a vertical cross-sectional view of a lower end portion of the door apparatus shown in FIG. 1.
Figure 4:
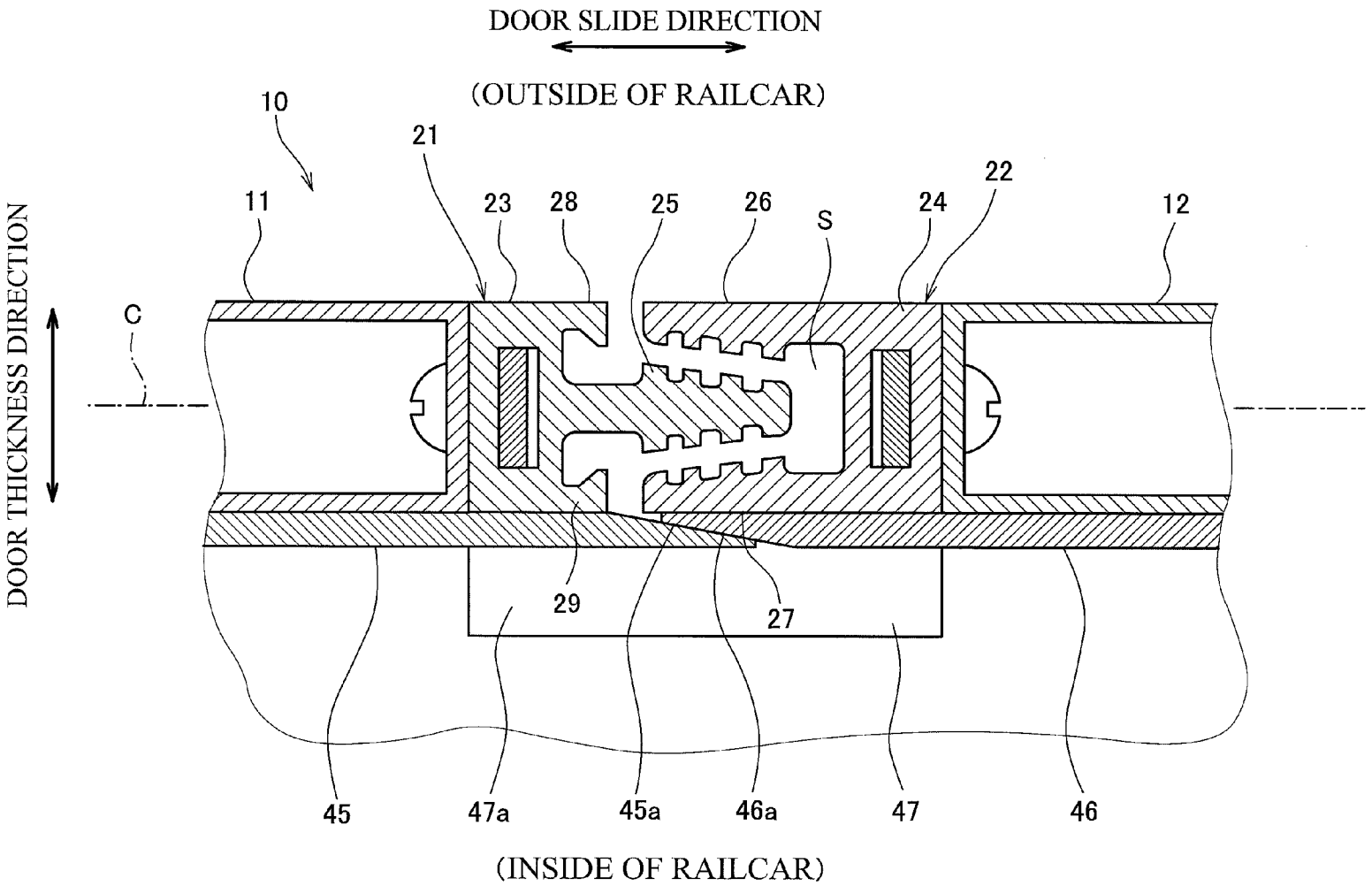
FIG. 4 is a horizontal cross-sectional view taken along line IV-IV of FIG. 3.

FIG. 3 is a vertical cross-sectional view of a lower end portion of the door apparatus 10 shown in FIG. 1. FIG. 4 is a horizontal cross-sectional view taken along line IV-IV of FIG. 3. As shown in FIGS. 3 and 4, a floor member 41 is provided at a railcar inner side of the side bodyshell 2 (FIG. 1) so as to be located above an underframe 40 of the railcar 1. A step 42 is located at a position lower than a floor surface 41*a* (an upper surface of the floor member) to project outward from a railcar width direction (door thickness direction) end portion of the floor member 41. The step 42 is fixed to the underframe 40 with a bolt B. A rail 43 is provided on the step 42. The first and second side sliding doors 11 and 12 are slidably guided by the rail 43. A gap 44 is formed between the rail 43 and the floor member 41 in the railcar width direction. A drain hole 42*a* is formed on a bottom wall located under the gap 44.

A first water stop plate 45 is provided on inner surfaces of lower end portions of the first side sliding door 11 and the first elastic member 21 so as to be fitted in the gap 44 with play therebetween. A second water stop plate 46 is provided on inner surfaces of lower end portions of the second side sliding door 12 and the second elastic member 22 so as to be fitted in the gap 44 with play therebetween. Tip ends of the first and second water stop plates 45 and 46 are opposed to each other. A first tapered surface 45*a* inclined relative to the door slide direction is formed at a tip end portion of the first water stop plate 45. A second tapered surface 46*a* inclined in a direction along the first tapered surface 45*a* and opposed to the first tapered surface 45*a* is formed at a tip end portion of the second water stop plate 46. Each of the tapered surfaces 45*a* and 46*a* is inclined relative to the door thickness direction at an angle larger than 45°. When the first and second side sliding doors 11 and 12 are completely closed, the first tapered surface 45*a* surface-contacts the second tapered surface 46*a*.

The floor surface 41*a* of the floor member 41 is provided with a pocket portion 47 that is recessed downward and opens toward the gap space S formed between the first elastic member 21 and the second elastic member 22 when the first and second side sliding doors 11 and 12 are completely closed. A bottom surface 47*a* of the pocket portion 47 is inclined downward toward the outside in the railcar width direction. In the present embodiment, the pocket portion 47 is provided at a position so as to cover the tapered surfaces 45*a* and 46*a* of the first and second water stop plates 45 and 46 when the first and second side sliding doors 11 and 12 are completely closed.

According to the above-explained configuration, since the gap space S is formed between the first elastic member 21 and the second elastic member 22 when the side sliding doors 11 and 12 are completely closed, the advantage of the contactless type can be achieved, that is, the clothes and the like of the passenger caught in the side sliding doors 11 and 12 are easily taken out. In addition, since the grooves 25*c*, 25*d*, 26*c*, 26*d*, 27*c*, and 27*d* extending in the vertical direction are formed on the outer surfaces, facing the gap space S, of the first to third projecting wall portions 25 to 27 that overlap one another when viewed from the normal direction of the side sliding doors 11 and 12 in a state where the side sliding doors 11 and 12 are completely closed, the lengths of these outer surfaces from the outside of the railcar to the inside of the railcar can be increased. With this, for example, the water having entered into the gap space S from the outside of the railcar falls down to a lower end of the gap space S before the water reaches the inside of the railcar. Thus, the water can be successfully prevented from entering into the inside of the railcar from the outside of the railcar.

In addition, since each of the grooves 25*c*, 25*d*, 26*c*, 26*d*, 27*c*, and 27*d* is formed from the upper end to the lower end of the first or second elastic member 21 or 22, the water can be successfully prevented from entering into the inside of the railcar from the outside of the railcar over the entire gap space S from the upper end to the lower end of the gap space S. Further, the water having entered into the grooves 25*c*, 25*d*, 26*c*, 26*d*, 27*c*, and 27*d* can be smoothly guided to the lower ends of the first and second elastic members 21 and 22.

Since each of the widths of the large grooves 25*c*, 26*c*, and 27*c* of the base-side portions 25*a*, 26*a*, and 27*a* is larger than each of the widths of the small grooves 25*d*, 26*d*, and 27*d* of the tip end-side portions 25*b*, 26*b*, and 27*b*, the large grooves 25*c*, 26*c*, and 27*c* can serve as gutters that mainly guide the water downward, and the small grooves 25*d*, 26*d*, and 27*d* can effectively receive the water overflowing from the large grooves 25*c*, 26*c*, and 27*c*.

The first base portion 23 includes the convex portions 28 and 29 spaced apart from the first projecting wall portion 25 in the door thickness direction and respectively projecting toward the tip ends of the second and third projecting wall portions 26 and 27. Thus, the space that receives the water is formed by the convex portions 28 and 29 and the first projecting wall portion 25, and the widths of entrances (a gap between the convex portion 28 and the second projecting wall portion 26 and a gap between the convex portion 29 and the third projecting wall portion 27) of the gap space S can be reduced.

Since the first and second water stop plates 45 and 46 are attached to the inner surfaces of the lower end portions of the first and second elastic members 21 and 22, it is possible to prevent a case where the water having dropped down in the gap space S splashes to enter into the inside of the railcar. When the first and second side sliding doors 11 and 12 are completely closed, the tapered surfaces 45*a* and 46*a* of the first and second water stop plates 45 and 46 contact each other in a wedge shape. Therefore, the water can be effectively prevented from entering through a gap between the first water stop plate 45 and the second water stop plate 46. In addition, since the tapered surfaces 45*a* and 46*a* of the first and second water stop plates 45 and 46 contact each other, the reaction force generated by this contact is applied in the normal direction of the tapered surfaces 45*a* and 46*a*, so that a component force, acting in the door slide direction, of the reaction force is reduced. Therefore, the abnormality detector 9 can be prevented from mistakenly detecting that the foreign matter is caught in the door, based on the resistance generated by the reaction force.

The pocket portion 47 that is recessed downward and open toward the gap space is formed at a portion of the floor member 41, the portion corresponding to the gap space S formed between the first elastic member 21 and the second elastic member 22 when the side sliding doors 11 and 12 are completely closed. Therefore, even if the water flows through the gap space S to enter into the inside of the railcar, the water is received by the pocket portion 47, so that the floor surface 41 is prevented from getting wet.

Embodiment 2

Figure 5:
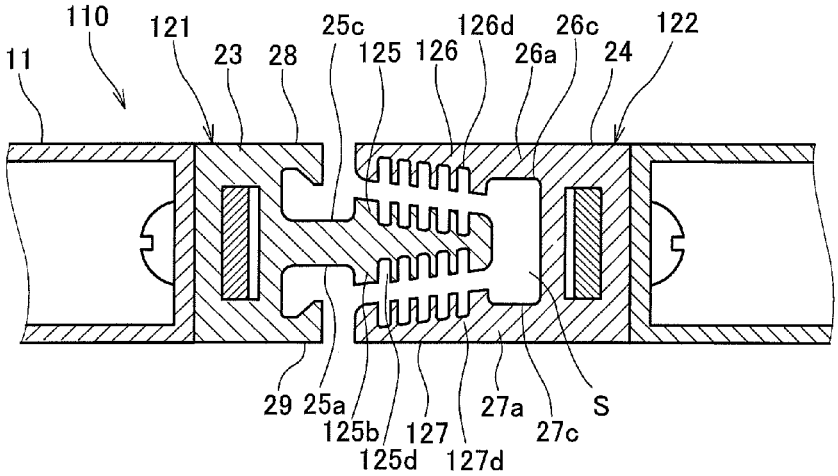
FIG. 5 is a diagram of the railcar door apparatus according to Embodiment 2 and corresponds to FIG. 2.

FIG. 5 is a diagram of a railcar door apparatus 110 according to Embodiment 2 and corresponds to FIG. 2. As shown in FIG. 5, in Embodiment 2, small grooves 125*d* of a first projecting wall portion 125 of a first elastic member 121 and small grooves 126*d* and 127*d* of second and third projecting wall portions 126 and 127 of a second elastic member 122 are narrower in width and larger in number than Embodiment 1. Specifically, each of the widths of the small grooves 125*d*, 126*d*, and 127*d* in the door slide direction is smaller than each of the depths of the small grooves 125*d*, 126*d*, and 127*d* in the door thickness direction. With this, the lengths of the side surfaces of the first to third projecting wall portions 125 to 127 from the outside of the railcar to the inside of the railcar can be increased. With this, the water can be successfully prevented from entering into the inside of the railcar from the outside of the railcar. The same reference signs are used for the same components as Embodiment 1, and explanations thereof are omitted.

Embodiment 3

Figure 6:
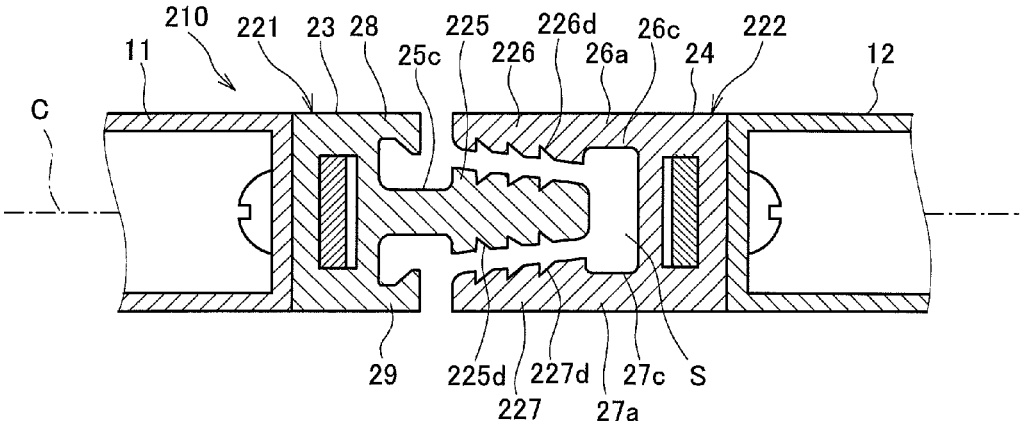
FIG. 6 is a diagram of the railcar door apparatus according to Embodiment 3 and corresponds to FIG. 2.

FIG. 6 is a diagram of a railcar door apparatus 210 according to Embodiment 3 and corresponds to FIG. 2. As shown in FIG. 6, in Embodiment 3, each of small grooves 225*d* of a first projecting wall portion 225 of a first elastic member 221 and small grooves 226*d* and 227*d* of second and third projecting wall portions 226 and 227 of a second elastic member 222 has a V-shaped cross section constituted by a short side and a long side, and each of the first elastic member 221 and the second elastic member 222 is symmetrical about the door center line C in the door thickness direction. An angle between the short side of the small groove 225*d*, 226*d*, or 227*d* and the outer surface of the first, second, or third projecting wall portion 225, 226, or 227 is more acute than an angle between the long side of the small groove 225*d*, 226*d*, or 227*d* and the outer surface of the first, second, or third projecting wall portion 225, 226, or 227. With this, short-side portions of the small groove 225*d*, 226*d*, and 227*d* can successfully receive the water. The same reference signs are used for the same components as in Embodiment 1, and explanations thereof are omitted.

Embodiment 4

Figure 7:
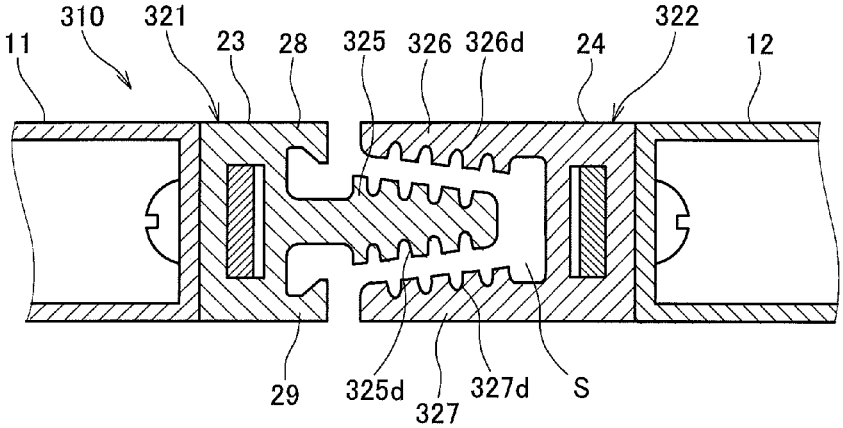
FIG. 7 is a diagram of the railcar door apparatus according to Embodiment 4 and corresponds to FIG. 2.

FIG. 7 is a diagram of a railcar door apparatus 310 according to Embodiment 4 and corresponds to FIG. 2. As shown in FIG. 7, in Embodiment 4, the positions of small grooves 325*d* of a first projecting wall portion 325 of a first elastic member 321 are different from the positions of small grooves 326*d* and 327*d* of second and third projecting wall portions 326 and 327 of a second elastic member 322 in the door slide direction. With this, each of a channel between the first projecting wall portion 325 and the second projecting wall portion 326 and a channel between the first projecting wall portion 325 and the third projecting wall portion 327 can be formed in a serpentine shape. The same reference signs are used for the same components as in Embodiment 1, and explanations thereof are omitted.

Embodiment 5

Figure 8:
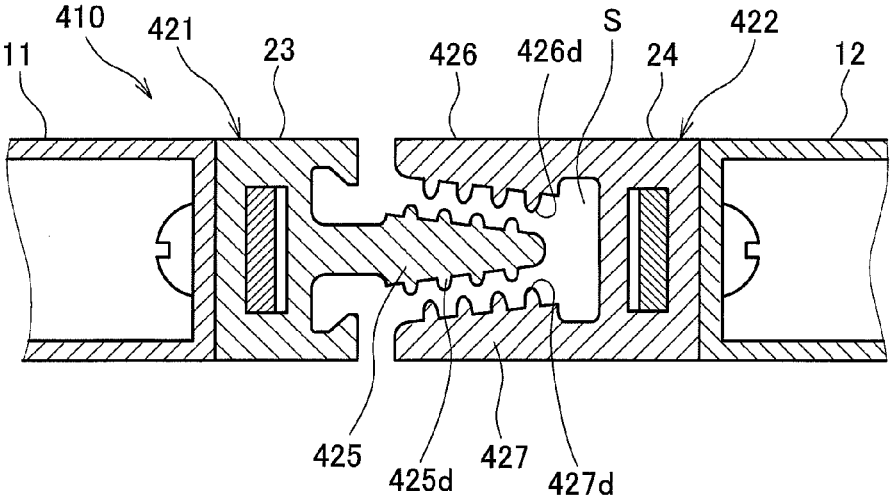
FIG. 8 is a diagram of the railcar door apparatus according to Embodiment 5 and corresponds to FIG. 2.

FIG. 8 is a diagram of a railcar door apparatus 410 according to Embodiment 5 and corresponds to FIG. 2. As shown in FIG. 8, in Embodiment 5, instead of the grooves, projections 425*d* are provided on a side surface of a first projecting wall portion 425 of a first elastic member 421, and projections 426*d* and 427*d* are respectively provided on side surfaces of second and third projecting wall portions 426 and 427 of a second elastic member 422. As with the grooves of Embodiments 1 to 4, the projections 425*d*, 426*d*, and 427*d* extend in the vertical direction. The positions of the projections 425*d* of the first projecting wall portion 425 are different from the positions of the projections 426*d* and 427*d* of the second and third projecting wall portions 426 and 427 in the door slide direction. The same reference signs are used for the same components as in Embodiment 1, and explanations thereof are omitted.

Embodiment 6

Figure 9:
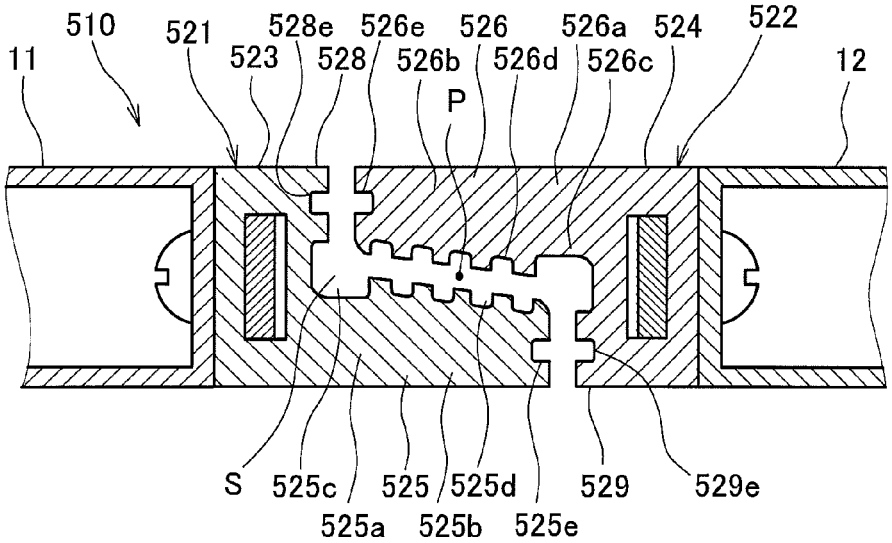
FIG. 9 is a diagram of the railcar door apparatus according to Embodiment 6 and corresponds to FIG. 2.

FIG. 9 is a diagram of a railcar door apparatus 510 according to Embodiment 6 and corresponds to FIG. 2. As shown in FIG. 9, in Embodiment 6, a first projecting wall portion 525 projects in the door slide direction from one of end portions of a first base portion 523 of a first elastic member 521, and a second projecting wall portion 526 projects in the door slide direction from one of end portions of a second base portion 524 of a second elastic member 522. To be specific, the first elastic member 521 and the second elastic member 522 are symmetrical about a center point P of the entire first elastic member 521 and second elastic member 522 in the door thickness direction and the door slide direction when the door apparatus is completely closed. Large grooves 525*c* and 526*c* recessed in the door thickness direction are respectively formed on base-side portions 525*a* and 526*a* of the first and second projecting wall portions 525 and 526. A plurality of small grooves 525*d* and 526*d* recessed in the door thickness direction are respectively formed on opposing surfaces of the first and second projecting wall portions 525 and 526. Further, a convex portion 528 spaced apart from the first projecting wall portion 525 projects from the first base portion 523 in the door slide direction, and a convex portion 529 spaced apart from the second projecting wall portion 526 projects from the second base portion 524 in the door slide direction. Small grooves 528*e* and 529*e* recessed in the door slide direction are respectively formed on tip end surfaces of the convex portions 528 and 529. According to this, since the first projecting wall portion 525 and the second projecting wall portion 526 can be made thick, the durability can be improved. The same reference signs are used for the same components as in Embodiment 1, and explanations thereof are omitted.

Embodiment 7

Figure 10:
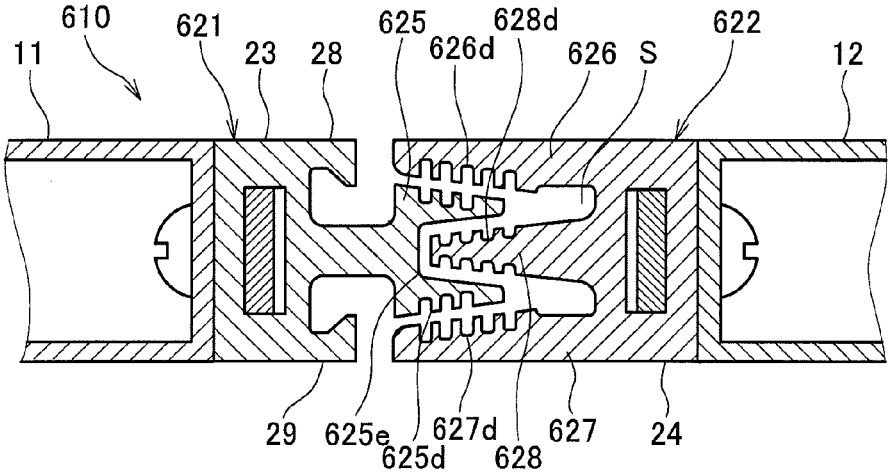
FIG. 10 is a diagram of the railcar door apparatus according to Embodiment 7 and corresponds to FIG. 2.

FIG. 10 is a railcar door apparatus 610 according to Embodiment 7 and corresponds to FIG. 2. As shown in FIG. 10, in Embodiment 7, a recess 625*e* is formed at a tip end of a first projecting wall portion 625 of a first elastic member 621. A fourth projecting wall portion 628 is provided between a second projecting wall portion 626 and a third projecting wall portion 627 of a second elastic member 622. When the side sliding doors 11 and 12 are completely closed, the fourth projecting wall portion 628 is inserted in the recess 625*e* so as not to contact the recess 625*e*. A plurality of small grooves 625*d* and 626*d* recessed in the door thickness direction are respectively formed on opposing surfaces of the first projecting wall portion 625 and the second projecting wall portion 626, and a plurality of small grooves 625*d* and 627*d* recessed in the door thickness direction are respectively formed on opposing surfaces of the first projecting wall portion 625 and the third projecting wall portion 627. Further, small grooves 628*d* are formed on a surface of the fourth projecting wall portion 628, the surface being opposed to the recess 625*e*. The same reference signs are used for the same components as in Embodiment 1, and explanations thereof are omitted.

The present invention is not limited to the above embodiments, and modifications, additions, and eliminations may be made within the scope of the present invention. The above embodiments may be combined arbitrarily. For example, a part of components or methods in one embodiment may be applied to another embodiment. The above embodiments have explained the side sliding doors 11 and 12 configured as a double door. However, the present invention may be applied to a side sliding door configured as a single sliding door. For example, the door apparatus may be configured such that: the first elastic member is attached to the door end of the side sliding door configured as the single sliding door; and the second elastic member is attached to a position of the side bodyshell, the position being opposed to the first elastic member when the side sliding door is completely closed. In a case where the first and second water stop plates are not adopted, the pocket portion may be provided at a range that covers at least an entrance of the gap space.

INDUSTRIAL APPLICABILITY

As above, the railcar door apparatus according to the present invention has an excellent effect of being able to successfully prevent water from entering into the inside of the railcar from the outside of the railcar although the door apparatus is a contactless type. Thus, it is useful to widely apply the present invention to the railcars that can utilize the significance of the above effect.

REFERENCE SIGNS LIST

1 railcar
2 side bodyshell
2*a* door opening portion
10, 110, 210, 310, 410, 510, 610 door apparatus
11 first side sliding door
12 second side sliding door
21, 121, 221, 321, 421, 521, 621 first elastic member
22, 122, 222, 322, 422, 522, 622 second elastic member
23 first base portion
24 second base portion
25 first projecting wall portion
25*a*, 26*a*, 27*a* base-side portion
25*b*, 26*b*, 27*b* tip end-side portion
25*c*, 26*c*, 27*c* large groove
25*d*, 26*d*, 27*d* small groove
26 second projecting wall portion
27 third projecting wall portion
28, 29 convex portion
45 first water stop plate
45*a*, 46*a* tapered surface
46 second water stop plate
47 pocket portion
S gap space

The invention claimed is:

1. A railcar door apparatus comprising:

a side sliding door configured to open and close a door opening portion of a side bodyshell of a railcar;

a first elastic member attached to a door end of the side sliding door in a vertical direction; and a second elastic member opposed to the first elastic member such that the entire second elastic member does not contact the first elastic member when the side sliding door is completely closed, wherein:

the first elastic member includes a first base portion and a first projecting wall portion projecting from the first base portion toward the second elastic member;

the second elastic member includes a second base portion and a second projecting wall portion projecting from the second base portion toward the first elastic member;

when the side sliding door is completely closed, a gap space is formed between the first elastic member and the second elastic member, and the first projecting wall portion and the second projecting wall portion are located so as to overlap each other when viewed from a normal direction of the side sliding door;

a plurality of grooves or projections extending in the vertical direction are formed on an outer surface of at least one of the first projecting wall portion and the second projecting wall portion, the outer surface facing the gap space; and when the side sliding door is completely closed, the grooves or projections do not contact the first projecting wall portion or the second projecting wall portion.

2. The railcar door apparatus according to claim 1, wherein the grooves or projections are formed from an upper end to a lower end of the outer surface.

3. The railcar door apparatus according to claim 1, wherein:

the groove is formed at a base side of at least one of the first projecting wall portion and the second projecting wall portion, and the grooves or projections are formed at a tip end side of said at least one of the first projecting wall portion and the second projecting wall portion; and a width of the groove formed at the base side is larger than each of widths of the grooves or projections formed at the tip end side.

4. The railcar door apparatus according to claim 1, wherein:

the first base portion is opposed to a tip end of the second projecting wall portion; and the first base portion includes a convex portion spaced apart from the first projecting wall portion in a horizontal direction and projecting toward a tip end of the second projecting wall portion.

5. The railcar door apparatus according to claim 1, further comprising:

a first water stop plate provided at a railcar inner side of a lower end portion of the first elastic member; and a second water stop plate provided at a railcar inner side of a lower end portion of the second elastic member and opposed to the first water stop plate in a state where the side sliding door is closed, wherein:

the first water stop plate includes a first tapered surface inclined relative to a slide direction of the side sliding door; and the second water stop plate includes a second tapered surface inclined in a direction along the first tapered surface and opposed to the first tapered surface.

6. A railcar comprising the door apparatus according to claim 1, wherein a floor provided at a railcar inner side of the side bodyshell includes a pocket portion that is recessed downward and opens toward the gap space formed between the first elastic member and the second elastic member when the side sliding door is completely closed.

* * * * *